United States Patent [19]

Hollmann

[11] Patent Number: 4,634,414

[45] Date of Patent: Jan. 6, 1987

[54] METHOD AND APPARATUS FOR MANUFACTURING FOLDING PAPER SACKS

[75] Inventor: Bernd Hollmann, Bielefeld, Fed. Rep. of Germany

[73] Assignee: Kochsiek Maschinenbau GmbH Soltau, Soltau, Fed. Rep. of Germany

[21] Appl. No.: 628,184

[22] Filed: Jul. 6, 1984

[30] Foreign Application Priority Data

Jul. 8, 1983 [DE] Fed. Rep. of Germany ..... 3324719

[51] Int. Cl.[4] ..... B31B 23/26; B31B 23/84; B31B 1/90

[52] U.S. Cl. ..... 493/213; 493/236; 493/262; 493/263; 493/933; 493/210; 493/212; 493/432

[58] Field of Search ..... 493/263, 262, 261, 260, 493/235, 231, 230, 213, 212, 930, 923, 11, 236, 257, 266, 425, 432, 435

[56] References Cited

U.S. PATENT DOCUMENTS

| | | | |
|---|---|---|---|
| 1,525,356 | 2/1925 | Arrouquier | 493/235 |
| 2,013,086 | 9/1935 | Baker | 493/234 |
| 2,217,493 | 10/1940 | Poppe | 493/260 |
| 2,753,768 | 7/1956 | Hahn et al. | 493/235 |
| 2,762,272 | 9/1956 | Taylor et al. | 493/213 |
| 2,818,003 | 12/1957 | Browning et al. | 493/11 |
| 2,895,387 | 7/1959 | Robinson et al. | 493/236 |
| 2,897,730 | 8/1959 | Browning | 493/11 |
| 3,180,237 | 4/1965 | Davis | 493/262 |
| 3,203,620 | 8/1965 | Becker | 383/85 |
| 3,237,534 | 3/1966 | Lissner | 493/213 |
| 3,322,041 | 5/1967 | Fesco | 493/262 |
| 3,472,130 | 10/1969 | Brockmuller | 493/213 |
| 3,537,359 | 11/1970 | Finke | 493/234 |
| 3,793,926 | 2/1974 | Honsel | 493/262 |
| 4,027,455 | 6/1977 | Rausing et al. | 493/212 |
| 4,106,395 | 8/1978 | Rochla | 493/234 |

FOREIGN PATENT DOCUMENTS

| | | | |
|---|---|---|---|
| 1436785 | 3/1969 | Fed. Rep. of Germany | 493/234 |

*Primary Examiner*—Francis S. Husar
*Assistant Examiner*—William E. Terrell
*Attorney, Agent, or Firm*—Sprung Horn Kramer & Woods

[57] ABSTRACT

A method of manufacturing folding paper sacks, especially gusseted sacks, wherein each sack is shaped out of a tubular section separated from a single- or multiple-layer tubular web and closed at both ends with folded bottoms is characterized in that each tubular section continues to be conveyed uninterruptedly parallel to the direction of travel of the tubular web once it has been separated from the tubular web and the forward and/or rear ends of the tubular sections are shaped during the continuous pass by prefolding and crimping over and by the application of adhesive to the folded bottom, transversely to the direction C of travel, and accordingly sealed. The machine for carrying out the method is characterized by, first, an initial folder with a transverse adhesive applicator for the rear end of the tubular section downstream of a deflection roller that is in turn downstream of the tube-forming station and, second, by another folder with another transverse adhesive applicator for the forward end of the tubular section, with both folders and both adhesive applicators operating transversely with respect to the direction of travel and positioned one following another in the direction of travel.

17 Claims, 9 Drawing Figures

C''
C'
D''
E''
B
22
4b
23
27
28
29
30
31
24
25
30a
35
36
4e
37
38
45
46
44
43
42
41
26
40
40a
1
47
3
52
48
32
33
34

METHOD AND APPARATUS FOR MANUFACTURING FOLDING PAPER SACKS

BACKGROUND OF THE INVENTION

The present invention relates to a method and an apparatus for manufacturing folding paper sacks, especially gusseted sacks, wherein each sack is shaped out of a tubular section separated from a single- or multiple-layer tubular web and closed at both ends with folded bottoms.

In the various embodiments of known methods and apparatus for manufacturing folding paper sacks, the tubular section is manufactured separately and the tubular sections are subsequently stacked. Adhesive is the applied and the folds introduced subject to transverse conveyance.

Thus the sacks are manufactured in several stages and different directions of travel, which is not only expensive from an engineering aspect but also has drawbacks in relation to economical and rational manufacture.

SUMMARY OF THE INVENTION

The object of the present invention is accordingly to provide a method and an apparatus for carrying out the method whereby folding paper sacks with valve inserts, gussets, and, if necessary, cover sheets can be manufactured simply, economically, and without waste in one uninterrupted and continuous pass.

This object is attained in a method in accordance with the invention, wherein each tubular section continues to be conveyed uninterruptedly parallel to the direction of travel of the tubular web once it has been separated from the tubular web and the forward and/or rear ends of the tubular sections are shaped during the continuous pass by prefolding and crimping over and by the application of adhesive to the folded bottom, transversely to the direction of travel, and accordingly sealed.

Each tubular section can be shaped first at one, preferably the rear, end and then at the other, preferably the forward, end by prefolding and crimping over and by the application of adhesive to the folded bottom, transversely to the direction of travel, and accordingly sealed.

A valve for each tubular section is inserted into the open web of material before the web is formed into a tube.

One or more cover sheets can be applied after one or more ends of a tubular section have been prefolded and crimped over.

A cover sheet with tear-off strips can be applied after the ends of a tubular section have been prefolded and crimped over.

Diagonal fold lines and transverse fold lines that will subsequently make the bottom of the sack box-shaped can be applied at the corners of both folded bottoms after the ends of a tubular section have been prefolded, crimped over, and sealed.

A transverse predetermined tear-open line can be applied to the tubular section in the vicinity of the inserted valve after the rear end of a tubular section has been prefolded and crimped over.

When a cover sheet is applied, the end of the tubular section without adhesive can only be crimped over and the resulting fold kept closed by a cover sheet applied with adhesive The object is also attained in an apparatus for carrying out the method in accordance with the invention in that it has, first, an initial folder with a transverse adhesive applicator for the rear end of the tubular section downstream of a deflection roller that is in turn downstream of the tube-forming station and, second, another folder with another transverse adhesive applicator for the forward end of the tubular section, with both folders and both adhesive applicators operating transversely with respect to the direction C of travel and positioned one following another in the direction of travel.

Each folder can have, first, a gripper cylinder that rotates around a horizontal axis extending transversely to the direction of travel and has gripper fingers and slotted strips on its surface and, second, a rotating or pivoting knife that is associated with one of the gripper cylinders and operates in conjunction with the slotted strips, and an overlayer that moves in relation to the first gripper cylinder and that is intended for the rear fold la can be associated with the initial folder and a rotating roller brush that is intended for the forward fold can be associated with the second folder.

The adhesive applicator in the initial folder can be positioned between its pivoting knife and the overlayer and the adhesive applicator in the second folder can be positioned between its pivoting knife and the roller brush.

An additional pivoting knife for making a predetermined tear-open line in the tubular section in the vicinity of the inserted valve can be associated with the pivoting knife in the second folder.

A cover-sheet application station can be positioned downstream of the second folder in the direction that the tubular section travels and can have, one following the other in the direction in which the cover sheet is pulled off, a cover-sheet reel, an advance, a perforator, a tear-off, an adhesive applicator, and a third gripper cylinder with gripper fingers that operates in conjunction with the second gripper cylinder.

A folder that produces the diagonal fold line at the corners of both folded bottoms can be positioned downstream of the second folder in the direction of travel.

A folder that produces the transverse fold line at the corners of one or both folded bottoms can be included.

The second transverse adhesive applicator, the overlayer, and the pivoting knife in the initial folder can be shifted out of their operating position to produce tubular sections that are not sealed at the end.

The cover-sheet application station and its gripper cylinder can be shifted into a non-operating position.

One of the two transverse folders can be shifted into a non-operating position.

The machine can have (a) at least one and preferably several reels of paper,
(b) a roller frame,
(c) a guide for the lateral edges of the layers of paper,
(d) a means to advance the paper,
(e) a perforator,
(f) a transverse adhesive applicator,
(g) an auxiliary means to advance the paper that unites the layers of paper into a web,
(h) a longitudinal adhesive applicator,
(i) a valve-insertion station,
(j) a tube-forming station,
(k) a separator,
(l) two transverse folders,
(m) a cover-sheet application station, (n) a sack removal way, and
(o) a sack stacker
one after the other along the direction of travel.

The invention extends with respect to the characteristics of both the method and apparatus claims not only to the characteristics in each claim but also to their combination.

The method and apparatus in accordance with the invention make it possible to simply, reliably, and economically manufacture folding paper sacks in one uninterrupted and continuous pass, specifically in the forward direction, whereby the sacks can be manufactured with gussets, valve inserts, applied cover sheets, predetermined tear-open lines, and diagonal fold lines in the corners, without interrupting the operation and without altering the direction of travel.

The essential features of the method in accordance with the invention are 1. application, at regular intervals that are synchronized with the speed at which the paper is traveling, of the valve inserts by means of adhesive to the web of material before it is formed into a tube,
2. closing the webs of material into a tube with or without gussets,
3. separation of the webs of materials into separate tubular sections,
4. prefolding and crimping over of a rear and of a forward area of the tubular section, with folding occurring transversely with respect to the direction of travel,
5. a transverse predetermined tear-open line next to the valve insert to facilitate opening the valve,
6. application of a cover sheet to one or both crimpings over,
7. production of diagonal transverse and corner folds to form a box-shaped bottom on the sacks, and
8. the potential for removing various components from operation by uncoupling or pivoting out.

The apparatus is simple, compact, and easy to maintain, while allowing economical sack manufacture at a high output.

Some preferred embodiments of the invention will now be described with reference to the attached drawings, wherein

DETAILED DESCRIPTION OF THE PREFERRED EMBODIMENTS

Figure 1:
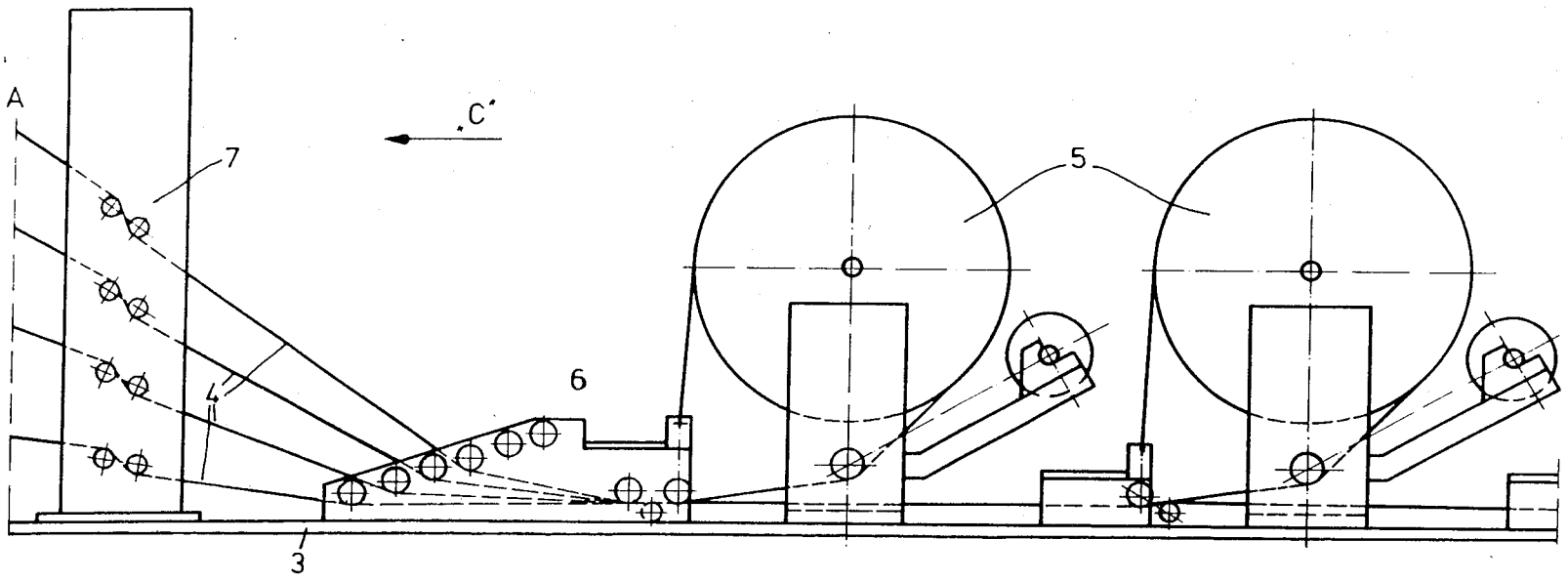
FIG. 1A, FIG. 1B and FIG. 1C are a schematic side views of a machine for manufacturing folding paper sacks in a straight-line, uninterrupted pass (in three separate sheets that join at points A—A and B—B)
Figure 1A:
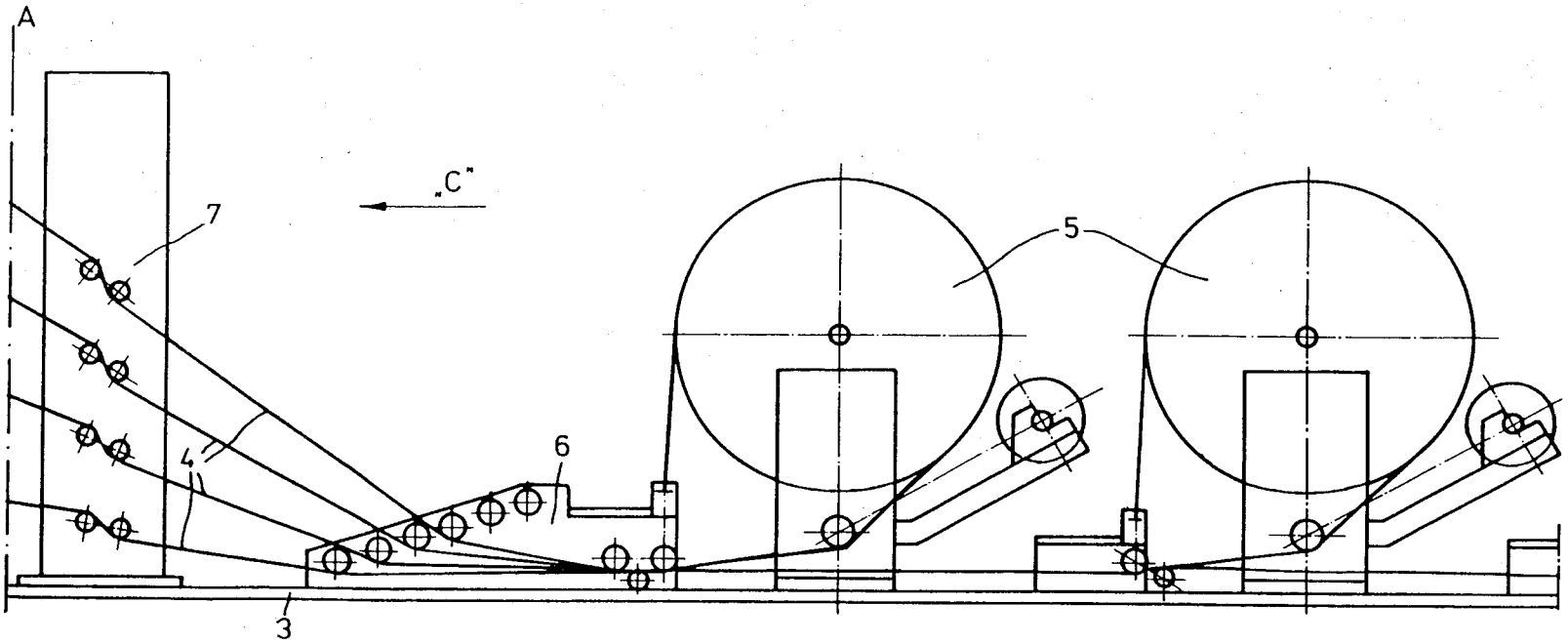
Figure 1B:
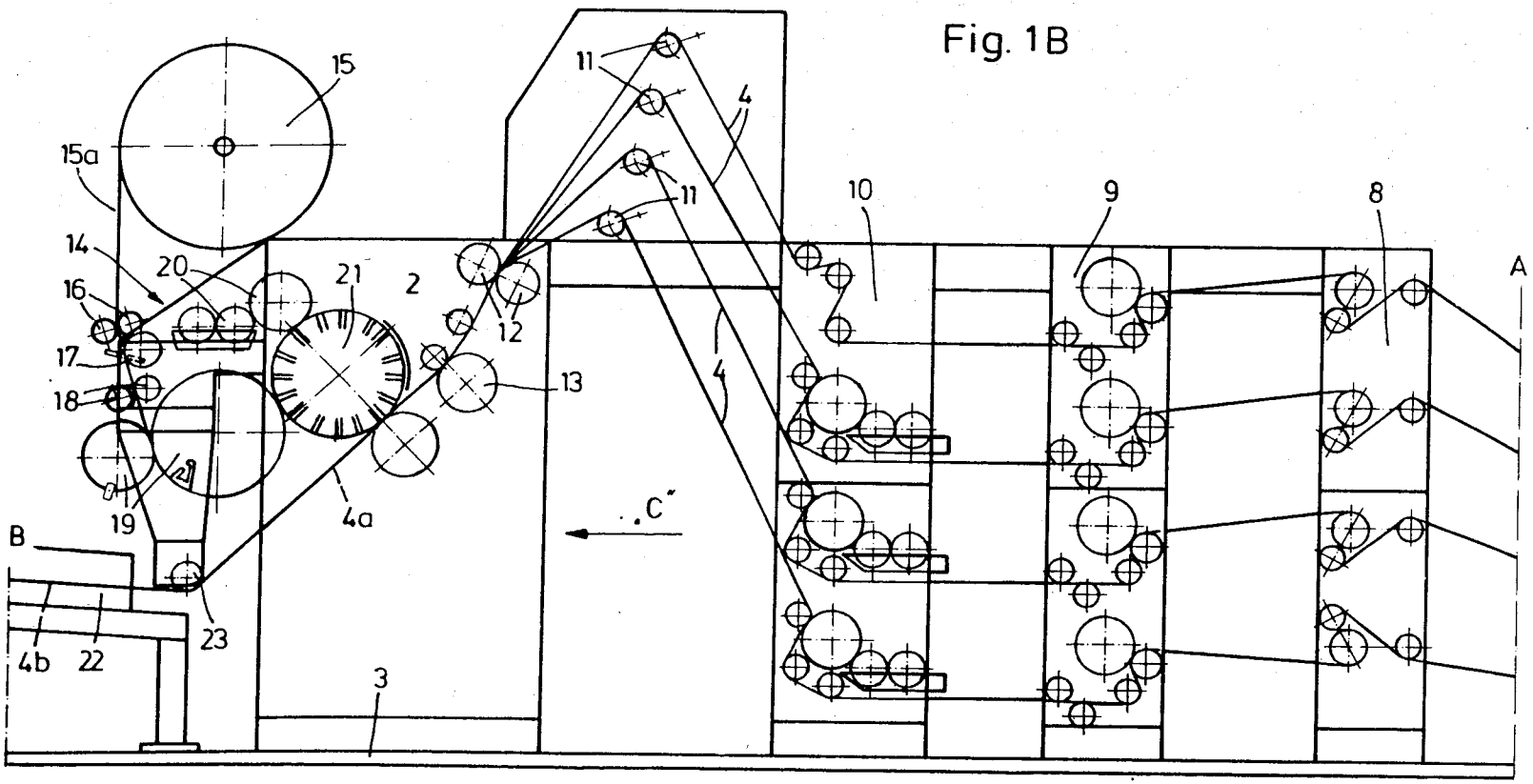
Figure 1C:
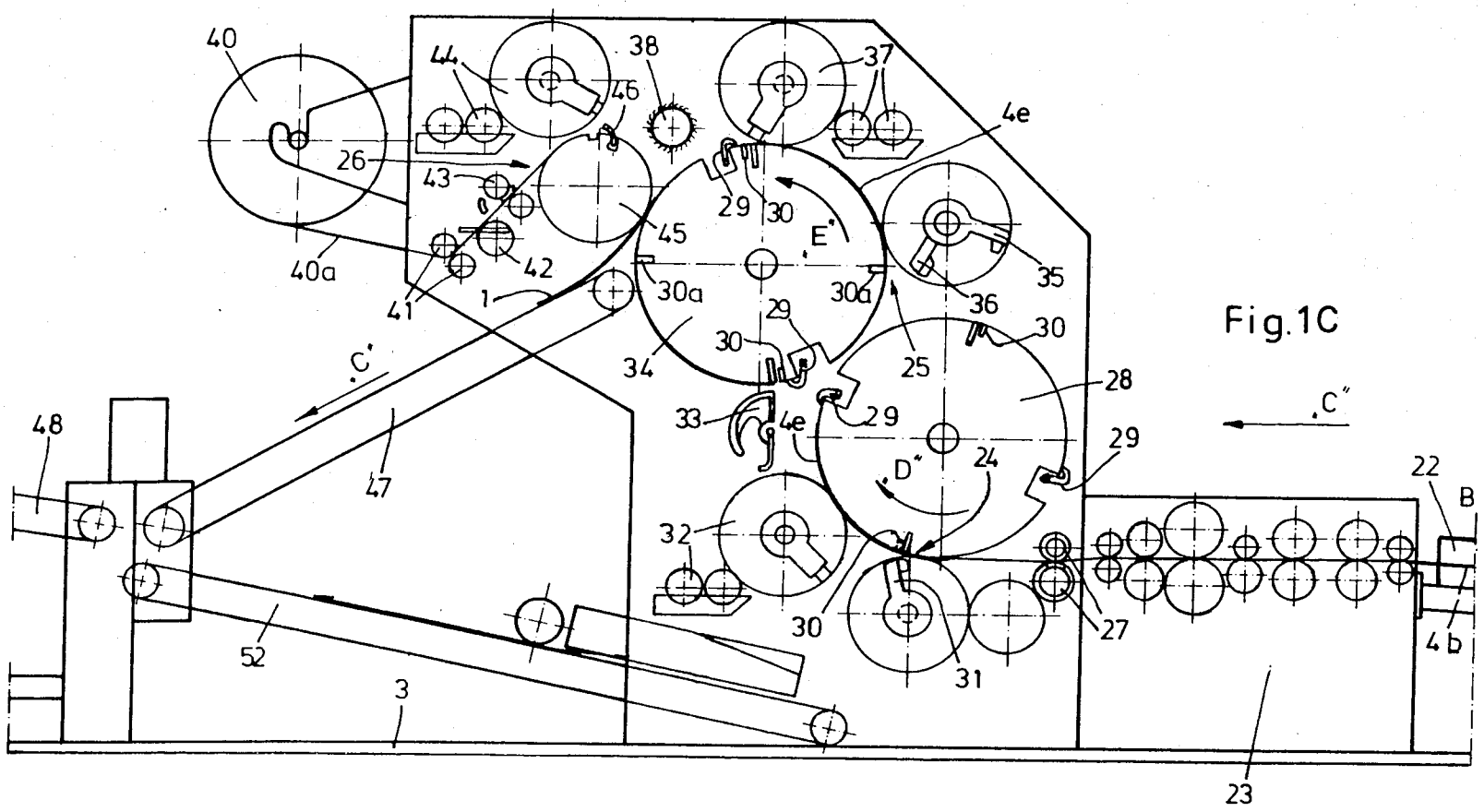

An apparatus in accordance with the invention for manufacturing folding paper sacks 1, especially gusseted sacks with a valve 2 through which the sack can be filled, includes all the devices and stations for manufacturing a sack 1 out of at least one and preferably two or more layers 4 of paper in one continuous (uninterrupted pass) along a straight line C parallel with the length of a sack. The devices and stations are arrayed along a base 3.

At one end of the apparatus, one and preferably several reels 5 of paper are mounted on base 3 in such a way as to rotate freely. A layer 4 of paper is obtained from each reel 5 and diverted one above another and with an interval between them through a roller frame 6.

Downstream of roller frame 6 along the direction C of travel is a lateral-edge guide 7 and downstream of the guide, one after the other in the direction of travel are an advance 8 for forwarding the separate layers 4 of paper, a perforator 9 for perforating lines in the individual layers 4 of paper so that the individual sections that will be formed later can be separated, and a transverse adhesive applicator 10 that permits the layers to be fastened together later into a multilayer web.

Downstream of transverse adhesive applicator 10 are deflection rollers 11 that the still separate layers 4 of paper are supplied through to a second, auxiliary, advance 12 that consists or rollers (cylinders). The traveling layers 4 of paper are united into one web **4*a* in the vicinity of auxiliary advance 12** and bonded together with the transversely applied adhesive.

Downstream of auxiliary advance 12 are rotating longitudinal adhesive-application disks 13 that apply adhesive to the longitudinal edges of web 4.

Downstream of longitudinal adhesive-application disks 13 is a valve-insertion station 14, which consists of a supply reel 15 with a layer **15*a* of paper for making a valve 2 wound on it, of a third advance 16, consisting of rollers (cylinders) associated with supply reel 15, of another perforator 17 for perforating lines in layer 15*a* so that the valves can be separated later, of an isolator 18 for ripping the sheets of valve paper from layer 15*a* in the vicinity of the perforations, of two fold-gripper cylinders 19 that operate in conjunction, of an adhesive applicator 20, and of a suction cylinder 21 that applies the folded valves 2 to web 4*a***.

Valve-insertion station 14 is followed by a tube-forming station 22 that guides web **4*a* with the valves 2 glued to it over a deflection roller 23 and in which web 4*a* is formed into a tube 4*b* by folding and creasing and by gluing its lateral edges together in such a way that tube 4*b*** has bellows sides.

Downstream of tube-forming station 22 is a separator 23 in which individual tubular sections **4*e* are torn or cut off from tubular web 4*b*** in the vicinity of the perforated lines as the web passes through.

Separator 23 is followed in order by a folder 24 for the rear end of the tubular section, by another folder 25 for the forward end of the tubular section, and by a cover-sheet application station 26, in which tubular section **4*e* is folded transversely and glued into a sack that is sealed at both ends. Between initial folder 24 and separator 23 is a fourth advance 27 for forwarding the individual tubular sections 4*e*** and consisting of rollers (cylinders).

Initial folder 24 consists of a gripper cylinder 28 that rotates on a horizontal axis extending transversely to the direction C of travel. Gripper cylinder 28 is provided with gripper fingers 29 and slotted beams 30 and operates in conjunction with a rotating or pivoting knife 31.

Rotating knife 31 is followed by another transverse adhesive applicator 32, which also operates in conjunction with gripper cylinder 28 and which applies adhesive to the rear end 4c of the tubular section. An folder 33 that pivots on or rotates around a horizontal axis extending transversely to the direction C of travel is also associated with gripper cylinder 28. Folder 33 folds rear fold 1a against the rear end 4c of the tubular layer in such a way that the fold can be glued to the tubular section 4e by the adhesive that has been applied to it.

Second folder 25 also has a gripper cylinder 34 that rotates around a horizontal axis extending transversely to the direction C of travel and that has gripper fingers 29 and slotted members 30 and 30a. A second rotating knife 35 and a third pivoting knife 36 are associated with second gripper cylinder 34. Both knives 35 and 36 rotate around a horizontal axis extending transversely to the direction C of travel. The distances between rotating knives 35 and 36 and between slotted members 30 and 30a can be adjusted as desired.

Downstream of rotating knives 35 and 36 is a third transverse adhesive applicator 37 that operates in conjunction with second gripper cylinder 34 and applies adhesive for fastening the forward end 4d of the tubular section. Third transverse adhesive applicator 37 is followed by a roller brush 38 that seals the forward end of the tubular section by folding forward fold 1b down and pressing it against end 4d. Roller brush 38 rotates around a horizontal axis extending transversely to the direction C of travel.

A station 26 for applying a cover sheet 39 has a cover-sheet reel 40. A fifth advance 41, consisting of rollers (cylinders) for example, extracts a web 40a of paper from cover-sheet reel 40. The individual cover sheets 39 are obtained from web 40a. Downstream of fifth advance 41 in the direction in which web 40a is extracted is a third perforator 42, a tear-off 43, and another adhesive applicator 44.

Adhesive applicator 44 operates in conjunction with a third gripper cylinder 45 with gripper fingers 46 that rotates around a horizontal axis extending transversely to the direction C of travel and releases the individual cover sheets 39 to sacks 1 while operating in conjunction with the gripper cylinder 34 in second folder 25.

Figure 3:
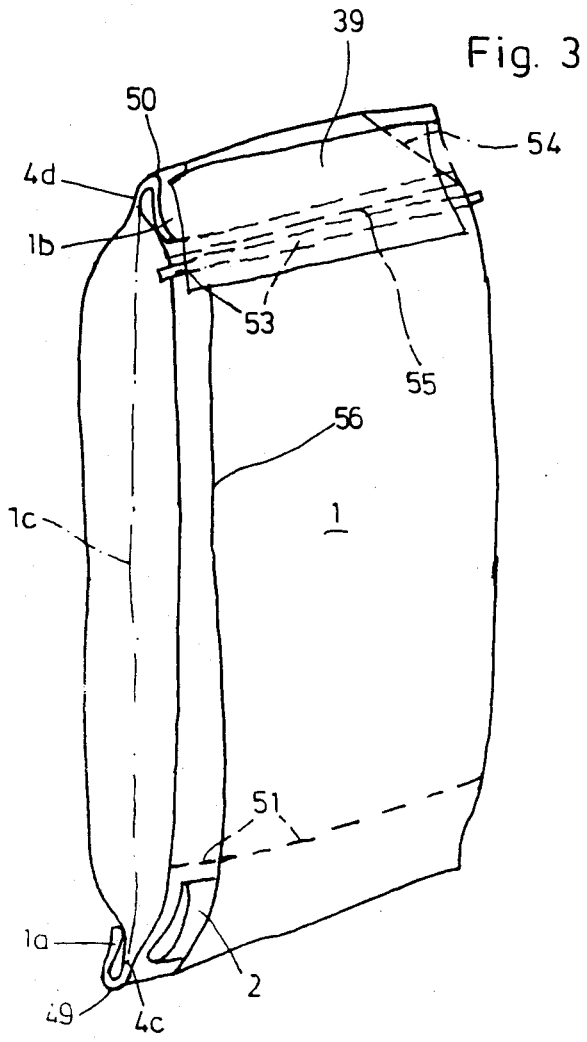
FIG. 3 is a perspective view of a bellows-sided sack with a valve, a cover sheet, and tear-off strips.

FIG. 3 illustrates a sack 1 with terminal folds 1a and 1b, folded tubular-section ends 4c and 4d, a lateral fold 1c, a valve 2, and a cover sheet 39 applied to the outer surface of the sack.

The gripper cylinders 34 and 45 that operate in conjunction are followed by a take-off 47, a conveyor belt for example, for removing finished sacks 1, and then by a sack stacker 48, a conveyor belt for example.

The operation of the apparatus just described and hence the method of manufacture in accordance with the invention will now be described.

The separate layers 4 of paper are obtained from reels 5, advanced separately through the sequence of devices 7, 8, 9, 10, and 11, and combined into one web 4a of material.

Valves are then isolated and folded in valve-insertion station 14 and applied by suction cylinder 21 to the still open web 4a, to which they adhere as the result of the previous appled adhesive. Valves 2 are applied at regular intervals that are synchronized with the speed at which web 4a travels.

Web 4a now travels with the valves in place through tube-forming station 22, where it is formed into a tube 4b, preferably with lateral folds 1c. Tubular web 4b is then separated into individual tubular sections 4e in separator The gripper fingers 29 of the gripper cylinder 28 in initial folder 24 now grip the front end 4d of each tubular section 4e and advance tubular section 4e, gripper cylinder 28 rotates in the direction indicated by arrow D and displaces tubular section 4e along its cylindrical surface over an arc of the cylindrical circumference.

Rotating knife 31 enters a slotted beam 30 in first gripper cylinder 28 and produces a predetermined tear-open line 49 at the rear end of tubular section 4e. Overlayer 33 then moves toward gripper cylinder 28 and folds rear fold 1a, which is demarcated by predetermined tear-open line 49, down against the end 4c of the tubular section, where the fold is glued to the section by the previously applied adhesive, sealing the rear end of the tubular section.

First gripper cylinder 28 transfers the forward end of tubular section 4e to the gripper fingers 29 of the gripper cylinder 34 in second folder 25, which rotates in the direction indicated by arrow E, carrying the section over part of the cylinder circumference.

During this motion second pivoting knife 35 again moves into one of the slotted beams 30 in second gripper cylinder 34 and produces a predetermined tear-open line 50 for forming forward fold 1b.

Third rotating knife 36 produces another predetermined tear-open line 51 in the tubular section in the vicinity of valve 2 facilitating the eventual opening of the valve when the sack is filled. The forward end of the tubular section is released downstream of third transverse adhesive applicator 37 and fold 1b is folded down against end section end 4d by roller brush 38 and fastened to it by the adhesive. The tubular section is now sealed at both ends.

Sack 1, which is now finished, sealed at both ends, and provided with a valve 2, can now be conveyed out of the machine to sack stacker 48 by take-off 47.

If the sack is to be provided with a cover sheet 39, which is applied across the width of the sack and on one side, cover-sheet application station 26 is engaged and a single cover sheet 39, supplied with adhesive, is applied to the side of the sack by third gripper cylinder 45 as the sack, sealed at each end, travels between gripper cylinders 34 and 45. Once a cover sheet 39 has been applied, the sack is conveyed out of the machine to sack stacker 48 by take-off 47.

When a sack 1 is equipped with a cover sheet 39 the covered end 4d of the tubular section does not need to be glued. It is possible to simply fold down fold 1b and then fasten it to cover sheet 39 with adhesive to seal the end of the sack in question. In so doing it is practical to insert a tear-off strip 53 (cf. FIG. 3) between the sack and the cover sheet and the sack at some distance from fold 1b while the sheet is being applied. When tear-off strip 53 is pulled, it will destroy the adhesion between cover sheet 39 and fold 1b, facilitating the opening of the sack at the end in question.

Another preferred embodiment features a folding station, not illustrated, downstream of second folder 25 that applies a diagonal fold line 54 at each corner of folds 1a and b at each end of the sack and, if necessary, another, transverse, fold line 55 to produce a polygonal, preferably rectangular, bottom in both ends of the sack, resulting in a box-shaped structure and facilitating the filling of the sack. Although FIG. 3 illustrates only one diagonal fold line 54 and one transverse fold line 55, a diagonal fold line 54 is located at each corner.

Figure 2:
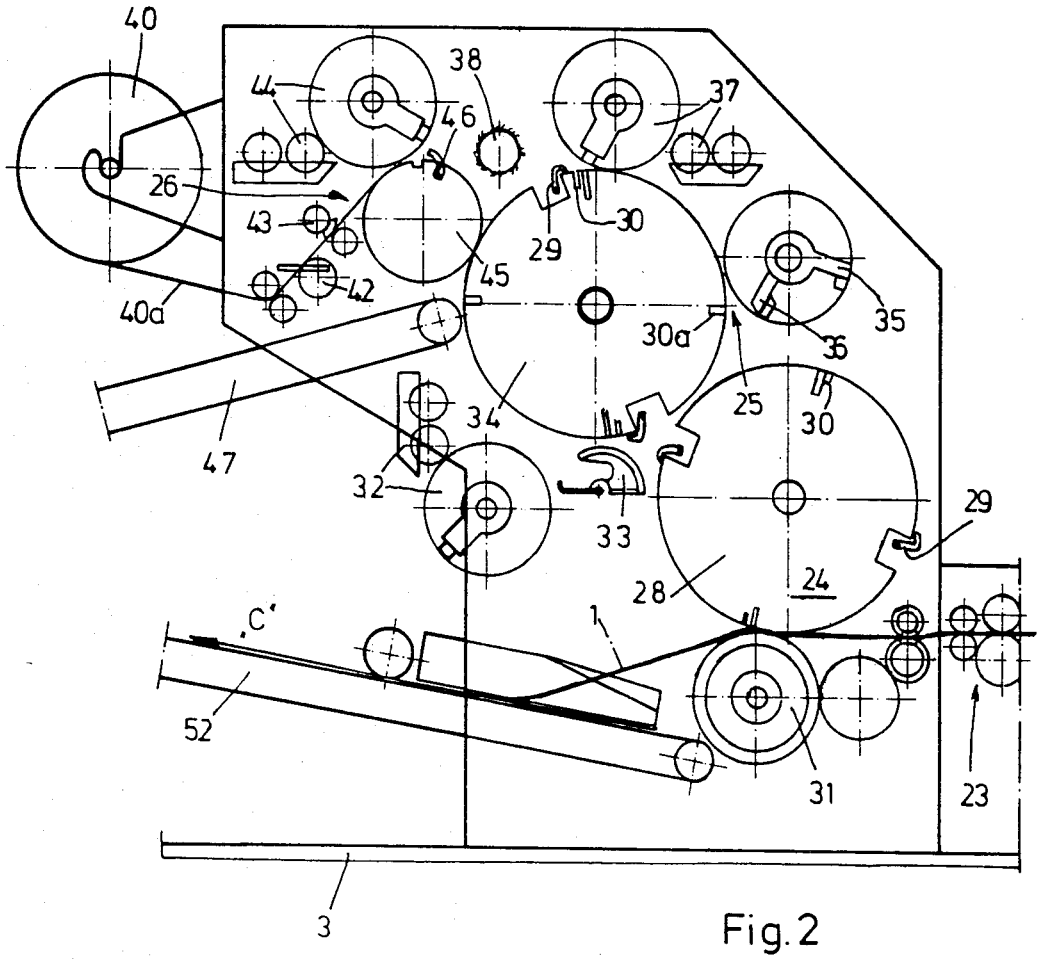
FIG. 2 is a schematic side view of the stations where both ends of a sack are folded and sealed and of a cover-sheet application station with the folding and sealing stations out of operation.

As illustrated in FIG. 2, second transverse adhesive applicator 32 and folder 33 can be pivoted into a non-operating position and first pivoting knife 31 deactivated, so that the tubular section will not pass between folders 24 and 25. This makes it possible to manufacture a conventional tube. Each tubular section will then be conveyed to sack stacker 48 by another take-off 52, a conveyor belt for instance.

Gluing cover sheet 39 over one or both of folds 1*a* and 1*b* is within the scope of the invention. Filling valve 20 will the extend within one end and tear-off strip 53, in the form of a strip of paper or plastic or of a rip-out thread, will be located in the opposite end of the sack.

Figure 4A:
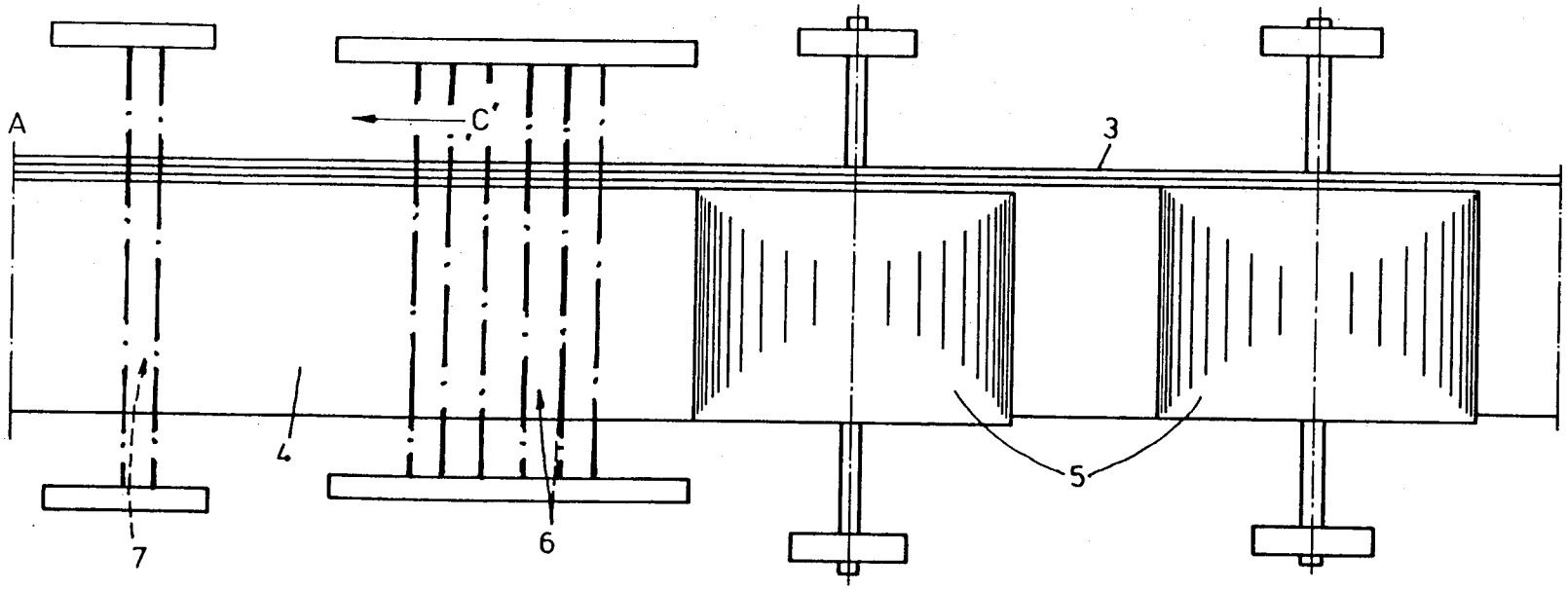
FIGS. 4A; 4B and 4C show in plan views an overall device in accordance with the present invention.
Figure 4B:
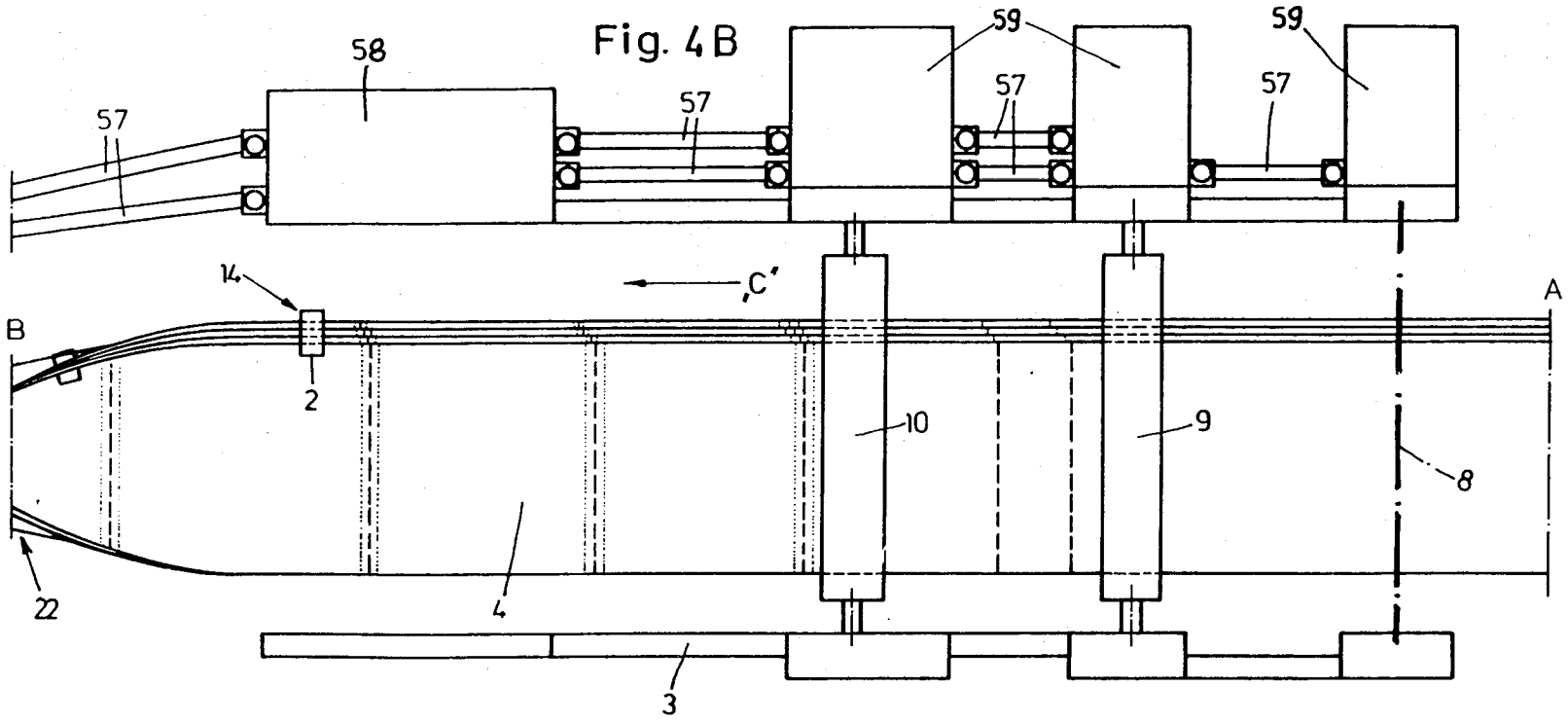
Figure 4C:
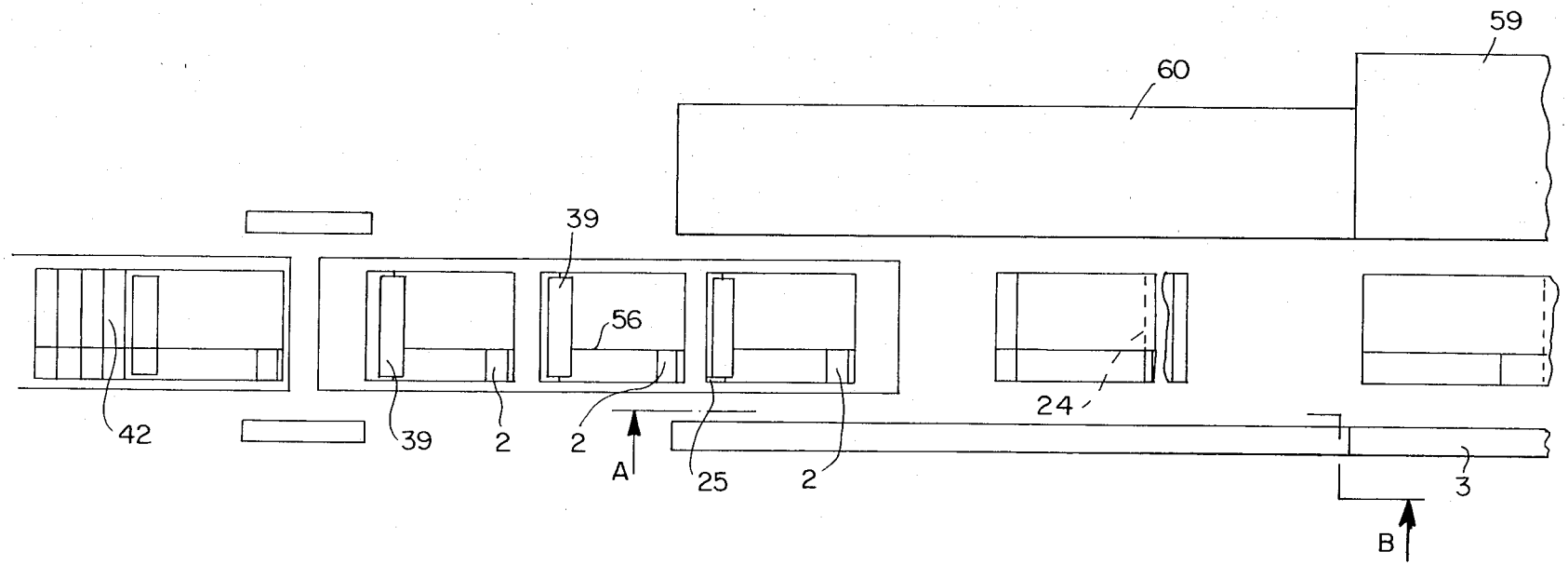
Figure 5:
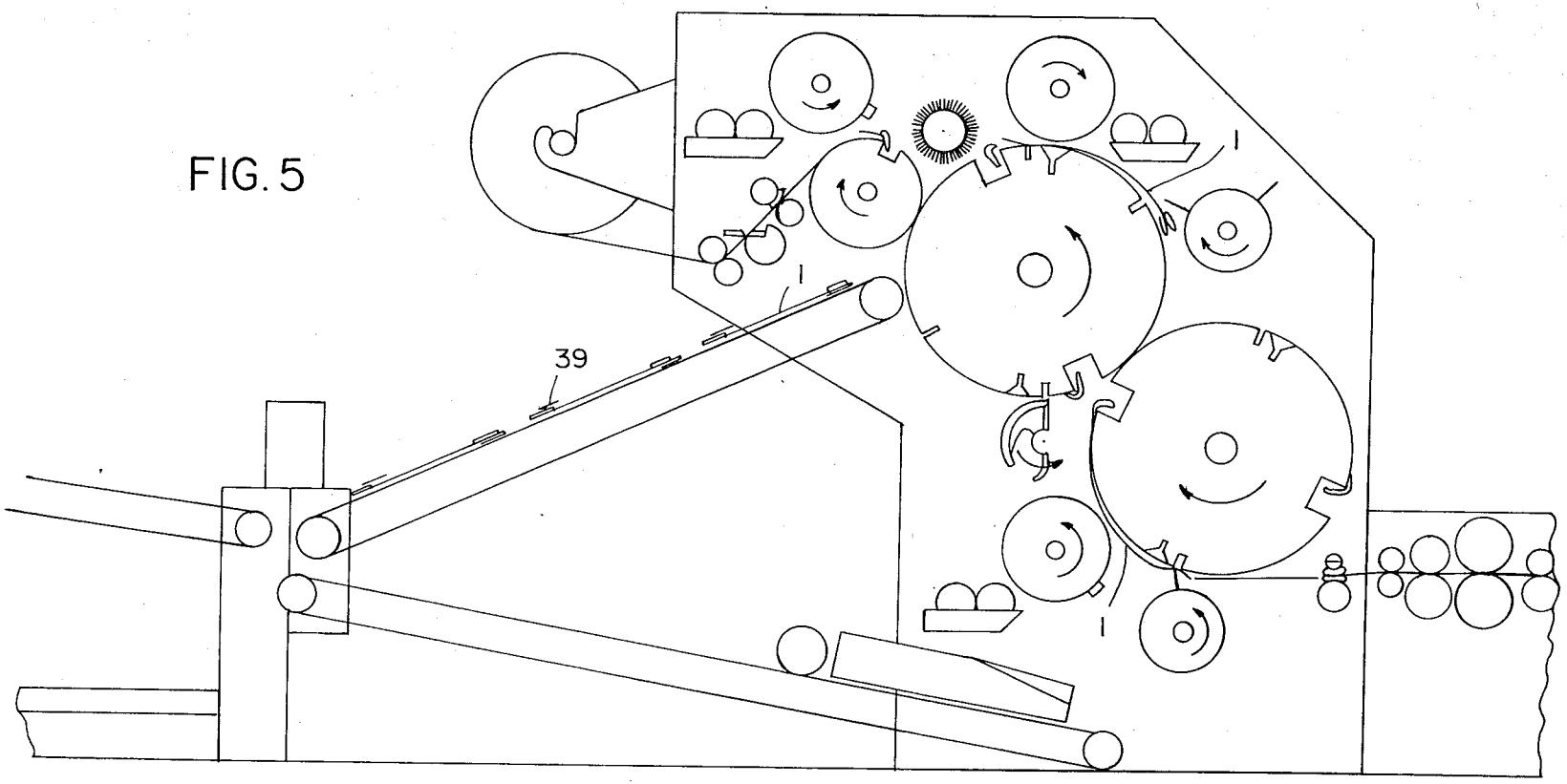
FIG. 5 is a schematic side elevational view (taken along line A—B of FIG. 4C) of a machine according to the present invention.

In FIG. 4, 57 is a driveshaft and 58 is a drive mechanism associated therewith.

It will be appreciated that the instant specification and claims are set forth by way of illustration and not limitation, and that various modifications and changes may be made without departing from the spirit and scope of the present invention.

What is claimed is:

1. A method of manufacturing folded paper sacks in an uninterrupted and continuous flow comprising the steps of (a) uninterruptedly conveying a web of paper in a longitudinal direction, applying and positioning a valve onto the web such that the valve extends traversely to the direction of travel of the web, (b) shaping the web, with the valve applied thereto, into a tubular web and closing the longitudinal edges of the tubular web by applying adhesive thereto, (c) separating individual tube blanks from the tubular web, (d) for each tubular blank, forming a sack closure at the longitudinal ends of the tubular blank, said forming step comprising in sequence initially longitudinally feeding a first side of the blank onto and facing the periphery of a first rotating gripper cylinder and transversely folding and glueing a first longitudinal end, then longitudinally feeding a second side of the blank onto and facing a second rotating gripper cylinder and transversely folding and gluing a second longitudinal end.

2. The method as in claim 1, further comprising applying one or more cover sheets after said shaping of the tubular blank.

3. The method as in claim 2, wherein, said cover sheet is applied with adhesive.

4. The method as in claim 1 further comprising applying one or more cover sheets containing tear-off strips.

5. The method as in claim 4, which further comprises forming diagonal fold lines and transverse fold lines at the corners of both folded ends after said shaping of the tubular blank.

6. The method as in claim 5, which further comprises applying a transverse predetermined tear-open line to the tubular blank in the vicinity of the inserted valve after said shaping of the tubular blank.

7. A method according to claim 1, wherein said web comprises one or more layers of paper.

8. A method according to claim 1, wherein each tubular blank is shaped first at a rear tubular-blank end and then at a forward tubular-blank end.

9. An apparatus for manufacturing folded paper sacks comprising:

(a) a means to move a web of paper along a longitudinal path, (b) a valve-insertion station disposed along said path downstream of said means to move a web of paper, said valve-insertion station defined by means for forming individual folded valves from valve material stock and for applying and positioning the valves on the web, (c) a tube-shaping station disposed along said path downstream of said valve-insertion station, said tube-shaping station defined by means for shaping the web into a tubular web and for sealing the longitudinal web thereof with adhesive, (d) a separating station disposed along said path downstream of said tube shaping station, said separating station defined by means for separating individual tubular blanks from the tubular web, (e) an initial folder and sealer assembly disposed downstream of said separating station, said initial folder defined by means for forming a longitudinally trailing sack closure by transversely folding and sealing a longitudinally trailing tubular blank end, comprising a gripper cylinder having gripper fingers and slotted strips on its surface and which rotates about a transverse axis and a rotating knife, an adhesive applicator and an overlayer associated with the gripper cylinder and (f) a second folder and sealer assembly disposed downstream of said initial folder and sealer assembly, said second folder and sealer assembly defined by means for forming a longitudinally leading sack closure by transversely folding and sealing a longitudinally leading tubular blank end, comprising a gripper cylinder having gripper fingers and slotted strips on its surface and which rotates about a transverse axis and a rotating knife, an adhesive applicator and a roller brush associated with the gripper cylinder.

10. The apparatus as in claim 9, wherein the adhesive applicator in the initial folder is positioned between its rotating knife and the overlayer and the adhesive applicator in the second folder is positioned between its rotating knife and the roller brush.

11. The apparatus as in claim 10, further comprising a third rotating knife for making a predetermined tear-open line in the tubular section in the vicinity of the inserted valve, said third rotating knife being being associated with the rotating knife in the second folder.

12. The apparatus as in claim 11, further comprising a cover-sheet application station, said cover-sheet application station being positioned downstream of the second folder in the direction that the tubular section travels, said cover sheet application station comprising, one following the order in the direction in which a cover sheet is pulled off, a cover-sheet reel, an advance, a perforator, a tear-off device, an adhesive applicator, and a third gripper cylinder with gripper fingers that operate in conjunction with the second gripper cylinder.

13. The apparatus as in claim 12, wherein a folder that produces the diagonal fold line at the corners of both folded bottoms is positioned downstream of the second folder in the direction of travel.

14. The apparatus as in claim 13, further comprising a folder that produces the transverse fold line at the corners of one or both folded bottoms.

15. The apparatus as in claim 14, wherein the adhesive applicator in the second folder, the overlayer folder, and the rotating knife in the initial folder are supported to be shiftable out of their operating position to produce tubular sections that are not sealed at the end thereof.

16. The apparatus as in claim 15, wherein the cover-sheet application station and its gripper cylinder can be shifted into a non-operating position.

17. The apparatus as in claim 16, wherein that one of the two transverse folders can be shifted into a non-operating position.

* * * * *